United States Patent [19]

Szczupak et al.

[11] Patent Number: 4,499,732

[45] Date of Patent: Feb. 19, 1985

[54] TURBOCHARGER HAVING A VARIABLE INLET AREA TURBINE

[75] Inventors: David T. Szczupak, Huddersfield; Brian E. Walsham, Holmfirth; Desmond J. Hooley, Marsden; David Flaxington, Bradford; Peter S. McKean, Huddersfield; John D. Wescott, Skelmanthorpe, all of England

[73] Assignee: Holset Engineering Company Limited, Huddersfield, England

[21] Appl. No.: 441,461

[22] Filed: Nov. 15, 1982

[30] Foreign Application Priority Data

Nov. 14, 1981 [GB] United Kingdom ..... 8134368

[51] Int. Cl.[3] ..... F01D 17/14; F02B 37/12

[52] U.S. Cl. ..... 60/602; 415/158

[58] Field of Search ..... 60/600, 601, 602, 603; 415/157, 158; 417/407

[56] References Cited

U.S. PATENT DOCUMENTS

| | | | |
|---|---|---|---|
| 1,322,810 | 11/1919 | Moody | 415/158 X |
| 2,846,185 | 8/1958 | Widmer | 415/150 |
| 2,861,774 | 11/1958 | Buchi | 60/602 X |
| 2,996,996 | 8/1961 | Jassniker | 415/158 X |
| 4,292,807 | 10/1981 | Rannenberg | 415/158 X |

FOREIGN PATENT DOCUMENTS

| | | | |
|---|---|---|---|
| 1428192 | 3/1969 | Fed. Rep. of Germany | 415/158 |
| 20213 | 2/1979 | Japan | 415/158 |
| 305214 | 1/1929 | United Kingdom | 415/158 |

*Primary Examiner*—Michael Koczo

*Attorney, Agent, or Firm*—Gary M. Gron; Robert T. Ruff

[57] ABSTRACT

A turbocharger for a diesel engine 34, wherein combustion air is supplied under pressure to the engine's intake manifold 32 from a centrifugal compressor 20 rotated by a turbine wheel 18 driven by exhaust gas from the engine supplied to inlet volute 44. Exhaust gas from the volute impinges on the turbine wheel after passing between stationary vanes 60 in an annular inlet passage between thin wall 52 and wall 46 of turbine housing 40. In this passage is a thin wall annular flange 64 slotted to fit over the vanes. The flange is part of a thin wall ring 62 stamped from stainless steel movable across the passage to control the inlet area thereof. The ring 62 is movable by actuators 80 (only one shown) having rods 74 connected to the ring. Springs 116 act on the rods 74 to urge the flange 64 towards the wall 46 thus reducing the area of the inlet passage so exhaust gas rushes through the reduced inlet and speeds the turbine and compressor providing at manifold 32 an increased air pressure. This increased pressure is used to urge diaphragm 100 in the actuators 80 in opposition to the springs and thus move ring 62 to increase the inlet passage area. The thinness of the ring 62 minimizes the chance that exhaust products will make it stick to vanes 46 and enables the ring to move quickly in response to actuators 80. Also the ring is cheap to make.

7 Claims, 6 Drawing Figures

TURBOCHARGER HAVING A VARIABLE INLET AREA TURBINE

The present invention relates to a variable inlet area turbine and more specifically one that may be used with turbochargers.

Turbochargers are used extensively in modern diesel engines to improve fuel economy and minimize noxious emissions. Such a turbocharger comprises a turbine wheel and housing, a compressor wheel and housing, and a central cast bearing housing between the wheels. The turbine wheel is journaled so that it rotates when driven by exhaust gases from an internal combustion engine to which it is connected. The turbine drives a compressor to compress engine combustion air, at a rate that is greater than the rate the engine can naturally aspirate. The turbocharger pressure output is a function of component efficiencies, mass flow through the turbine and compressor and the turbine.

One problem that occurs with turbochargers is that acceleration of an engine from a relatively low rpm is accompanied by a noticeable lag in the pressure increase from the turbocharger resulting in a noticeable lag in vehicle acceleration. The reason for this is that the inlet area of the turbine is designed for maximum rated conditions. As a result, the velocity of the gases passing across the turbine wheel at low engine rpm allow the turbocharger rpm to drop to such a low level that a substantial increase in gas velocity is required to increase the turbocharger rpm.

In order to overcome this deficiency, a number of schemes have been proposed to provide the turbocharger with a variable inlet area so that at low engine rpm the area may be made small to increase the velocity of the exhaust gases and maintain the turbocharger at a sufficiently high rpm to minimize lag.

British patent specification No. 1,138,941 describes an example of a variable inlet area arrangement where an annular ring is movable across the turbine inlet to vary the axial dimensions and thus increase or decrease the overall inlet area. The ring has a series of recesses which conform to fixed turbine inlet vanes to permit free movement of the ring. Although it is directed to waterflow, the variable area turbine inlet of U.S. Pat. No. 2,846,185 displays a similar arrangement but includes actuating modules located outside the turbine housing.

The problem with these prior approaches is that the deposit laden exhaust of an internal combustion engine very quickly fills up the sliding surface between the elements and eventually causes them to stick and may impair their function. For this reason, there have been no practical applications of variable area turbine control of this general type. Furthermore, the complex shapes, such as in British patent specification No. 1,138,941 require expensive manufacturing techniques and involve the use of expensive high temperature alloys which have attendant problems of thermal expansion.

The above problems are solved, according to the present invention, by a turbine comprising a turbine housing, a radial inward flow turbine wheel mounted for rotation within the housing. The housing has an annular inlet passage defined by two generally radially extending opposed side walls adjacent the periphery of the turbine wheel through which passage a fluid flows for driving the wheel. A means is provided for controlling the flow area of said passage, the control means comprising an axially displaceable ring section and an integral inwardly directed thin wall flange and means for displacing the ring so as to vary the flow area of the passage.

The invention will now be further described by way of example, with reference to the accompanying drawings, in which.

Figure 1:
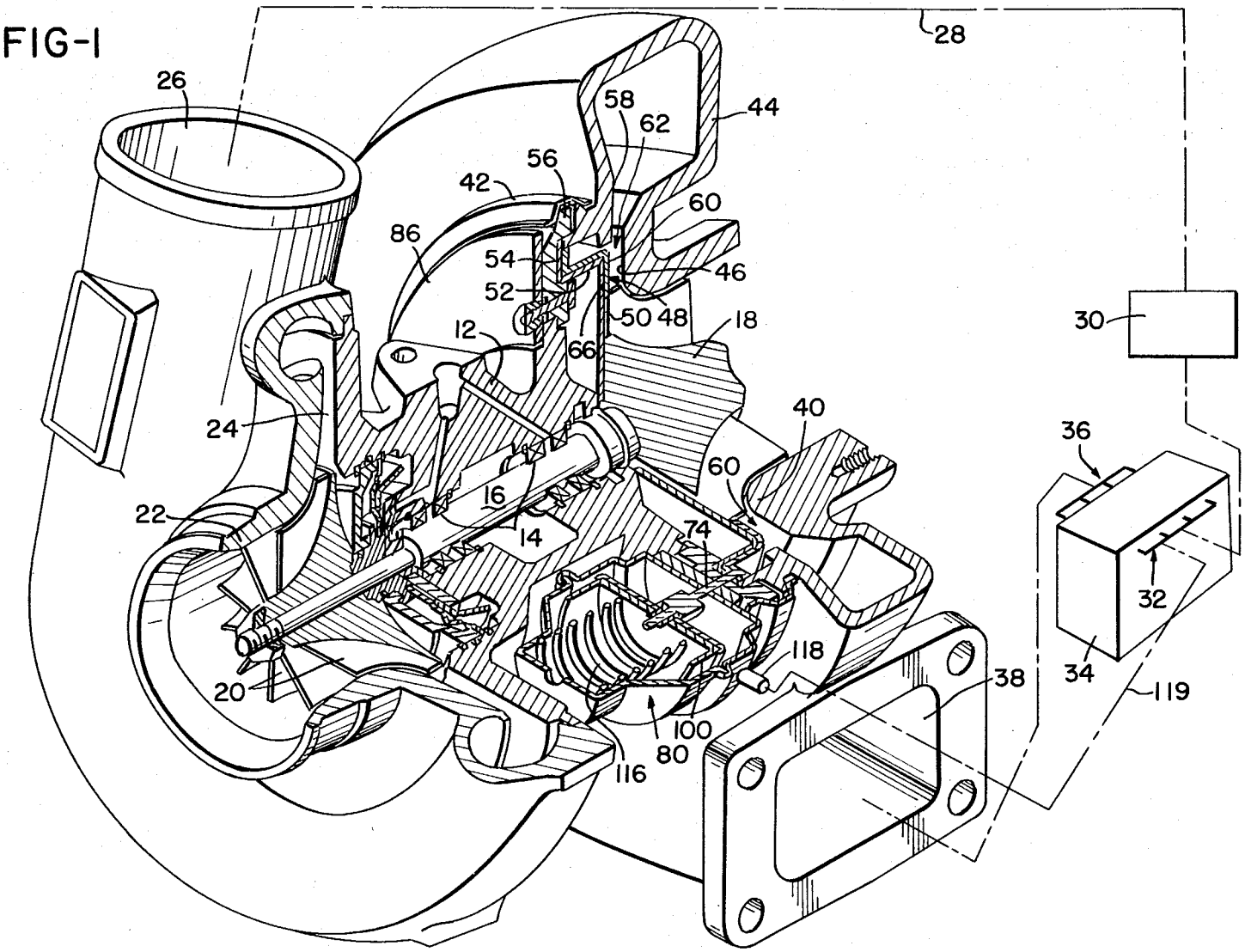
FIG. 1 is a simplified perspective view of a turbocharger which incorporates a variable inlet area turbine embodying the present invention.

FIG. 1 shows a turbocharger comprising a central cast bearing housing 12 having a pair of sleeve bearings 14 for supporting a shaft 16 that is attached to a radial inward flow turbine wheel 18. The turbine wheel 18 drives the shaft 16 which is in turn connected to a centrifugal compressor 20, contained within a compressor housing 22. Rotation of the compressor 20 accelerates air which is discharged into an annular diffuser 24 and then to a scroll-like outlet 26 for converting the velocity head into a static pressure head. Pressurized air is directed from the outlet 26, through an appropriate conduit 28, past an aftercooler 30 if desired, and then to an intake manifold 32 of a reciprocating internal combustion engine 34.

The internal combustion engine utilizes the compressed air to form a combustible mixture which is ignited to drive the engine. The products of combustion are fed through an exhaust manifold 36 to an inlet 38 of an inlet volute 44 of a turbine housing 40 which is secured to the bearing housing 12 by a clamp band 42. The volute 44 feeds an annular inlet passage consisting of opposed, radially extending side walls 46 and 48 respectively. The wall 46 is integral with the turbine housing 40, but the wall 48 consists of a thin wall ring 52 having an integral, inwardly directed flange 50 and an integral outwardly extending flange 54. The flange 54 lays in annular recess 58 of a turbine back plate 56 and is sandwiched between it and the turbine housing 40 by a clamp band 42. A series of vanes 60 are fixed to flange 50 by a suitable method, for example welding or riveting. The vanes 60 are oriented so that they direct incoming gas flow in a tangential direction to provide the appropriate gas flow.

Figure 2:
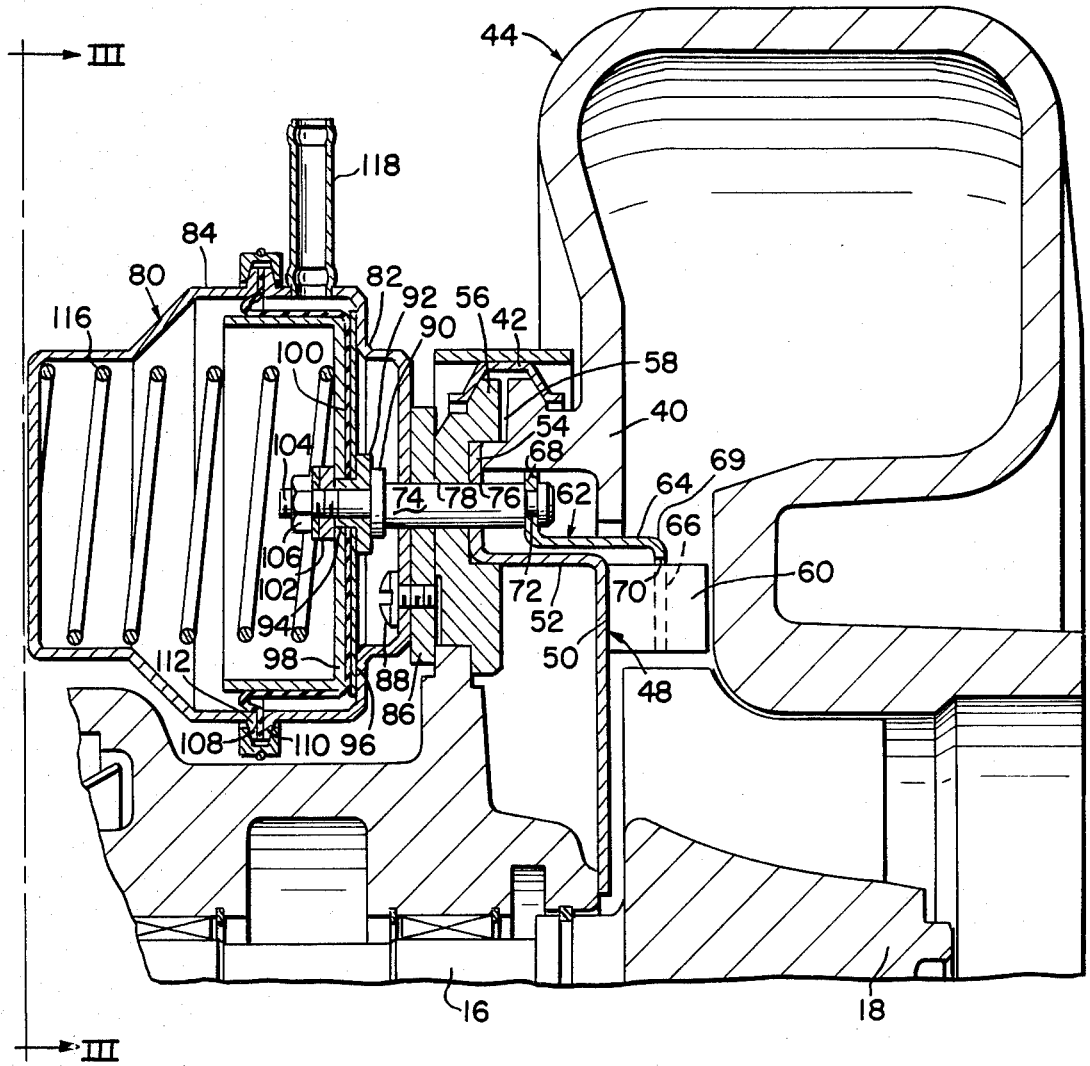
FIG. 2 is a fragmentary, longitudinal section view on an enlarged scale of the turbocharger illustrated in FIG. 1.

As shown in FIG. 2, a variable area control mechanism is incorporated in the turbocharger. The mechanism includes an area control element 62 comprising an annular thin wall ring or sleeve section 64 having an integral, radially inwardly directed thin wall flange 66 and an integral, radially outwardly directed flange 68. Preferably the thickness of the flange 66 does not exceed about six percent of the outer diameter of the ring shaped array of the vanes 60. Preferably, the junction of the flange 66 with the ring section 64 is rounded at 69 to promote smooth gas flow. It should be noted that the inner diameter of ring 64 is selected so that it is loosely piloted over ring or sleeve section 52. Flange 66 has a plurality of slots 70 which accept the vanes 60 to permit sliding movement of ring section 64 between the side walls 46 and 48. Flange 68 has a plurality of holes 72 each of which receives a shaft 74 extending through a hole 76 in the flange 54. As illustrated in FIG. 2, the hole 72 is a keyhole slot to receive and affix shaft 74 to flange 68. The shaft 74 also extends through 78, back plate 56, actuator mounting plate 86, and an actuator housing element 82. Housing element 82 is fixed to the actuator mounting plate 86 by screws 88. Plate 86 is in turn connected to back plate 56 by a plurality of fasteners, not shown. Shaft 74 connects with an actuator module 80 comprising an annular housing element 84 connected to element 82. Shaft 74 has an integral shoulder 90 which provides a stop for an insulating bushing 92. Bushing 92 has a boss 94 to pilot a flexible rolling diaphragm 100 sandwiched between a disc 96 and cup 98. Another insulating bushing 102 is received over the threaded end 104 of shaft 74, and a nut 106 clamps the diaphragm and associated elements between bushing 102 and flange 90. The outer periphery 108 of the rolling diaphragm 100 is clamped between flanges 110 and 112 of housing elements 82 and 84, respectively. A spring 116 acts against the interior of housing 84 to push diaphragm 100 and, in turn, shaft 74 towards the right as viewed in FIG. 2. The interior of housing element 82 receives an air pressure control signal through an inlet fitting 118. As illustrated in FIG. 1, fitting 118 can be connected to the inlet manifold 32 of the engine 34 through a conduit 119.

Figure 3:
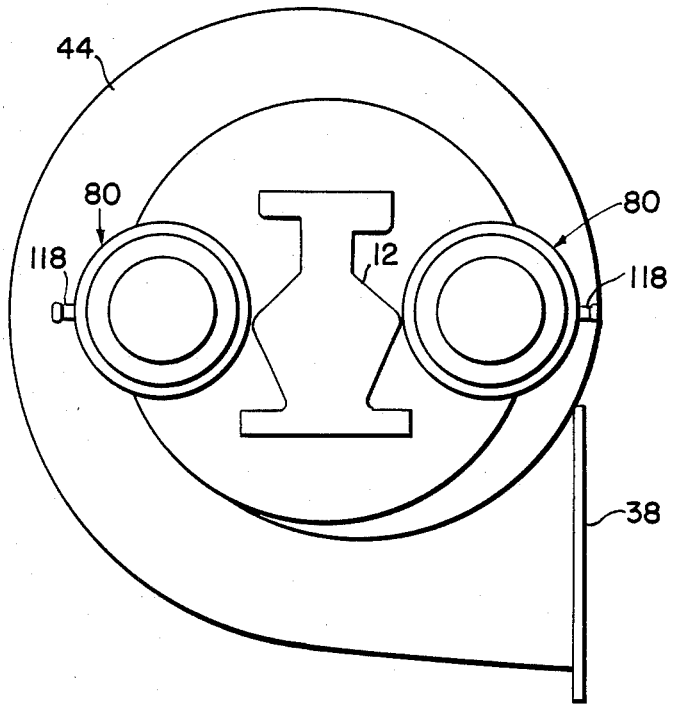
FIG. 3 is a diagrammatic cross-sectional view on line III—III in FIG. 2.

As shown in FIG. 3, actuator modules 80 are positioned to the side of the bearing housing 12. Preferably, there are two modules (only one is shown in FIG. 1) secured to points located 180 degrees from each other around flange 68 to provide the primary support of the area control element 62 and to locate it.

During operation the turbine wheel 18 is rotated by the passage of exhaust gases from engine exhaust manifold 36. Rotaion of turbine wheel 18 causes compressor 20 to rotate and pressurize air for delivery to the intake manifold 32 of the engine 34. The spring 116 pushes the area control element 62 towards a position of minimum flow area. When the element 62 is in this position, the ring section 64 is a barrier to flow and flange 66 acts as one wall of the inlet passage so that the gases must flow between it and the opposed wall 46 of the turbine housing. This causes the gas flow to accelerate and achieve a higher entry velocity around the turbine wheel 18. The increase in velocity causes an increase in turbine rpm to increase the air pressure in intake manifold 32.

Conduit 119 senses the pressure in the intake manifold 32 and applies it across the right face of the flexible diaphragm 100 in opposition to the force of the spring 116. When the manifold pressure starts to exceed a given level selected by the strength of the spring 116, the air pressure inside housing 82 pushes the flexible diaphragm 100 thereby displacing the area control element 62 to a more open position. This in turn increases the flow area and reduces the velocity of the gases entering the turbine. It can be seen then that the variable area control mechanism varies the velocity entering the turbine to achieve a controlled pressure level at the intake manifold 32.

Because the area control element 62 is relatively thin and can be of stainless steel and can be formed by stamping or pressing it has the following advantages over other control elements:

1. Minimum side edge surface area on which exhaust gas desposits can accumulate so that the element does not tend to seize in any position.
2. Ease of manufacture.
3. Low cost of manufacture.
4. Reduced thermal stresses due not only to the thinness but also to the rounded junction 69 (the junction also improves gas flow around this area control element).
5. Low inertia due to its light weight which results in improved responsiveness to changes in intake manifold pressure.
6. Lack of restriction of turbine inlet area when this element is in the fully open position. As shown in FIG. 2 the face of flange 66 exposed to the gas flow would be substantially in line with the adjacent inner wall of turbine housing 40 if flange 66 is displaced all the way to the left.
7. Little or no increase in the size of the turbine housing.

The variable area control mechanism of FIGS. 1 to 3 is set up to push the flow area control element 62 towards the minimum area position. The mechanism shown in FIGS. 4 to 6 pushes the area control element 62 towards the maximum area position. In this latter embodiment, in which parts that are identical to those of FIGS. 1 to 3 have identical reference numbers, a second housing 120 is secured to a first housing 121 by a clamp band 114. The periphery of a diaphragm 123 is clamped between housings 120 and 121. The movable center portion of diaphragm 123 is sandwiched between plates 125 and 127 which are fixed against a shoulder 113 of an actuating shaft 129 by the insulating bushings 92, 102 and the nut 106. Shaft 129 is arranged to abut flange 68 of the area control element 62. Housing 120 receives a pressure control signal through an inlet fitting 122 to push diaphragm 123 to the right.

Figure 6:
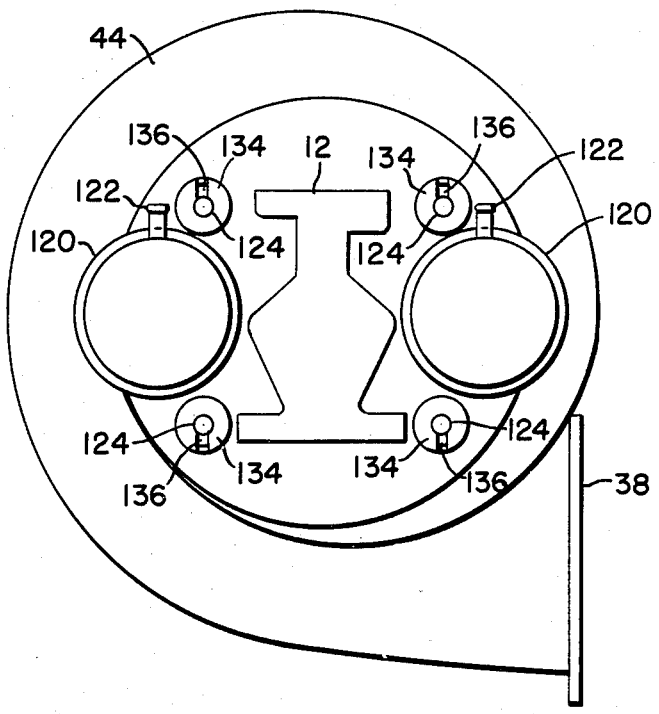
FIG. 6 is a diagrammatic cross-sectional view on lines VI—VI of FIG. 4.
Figure 5:
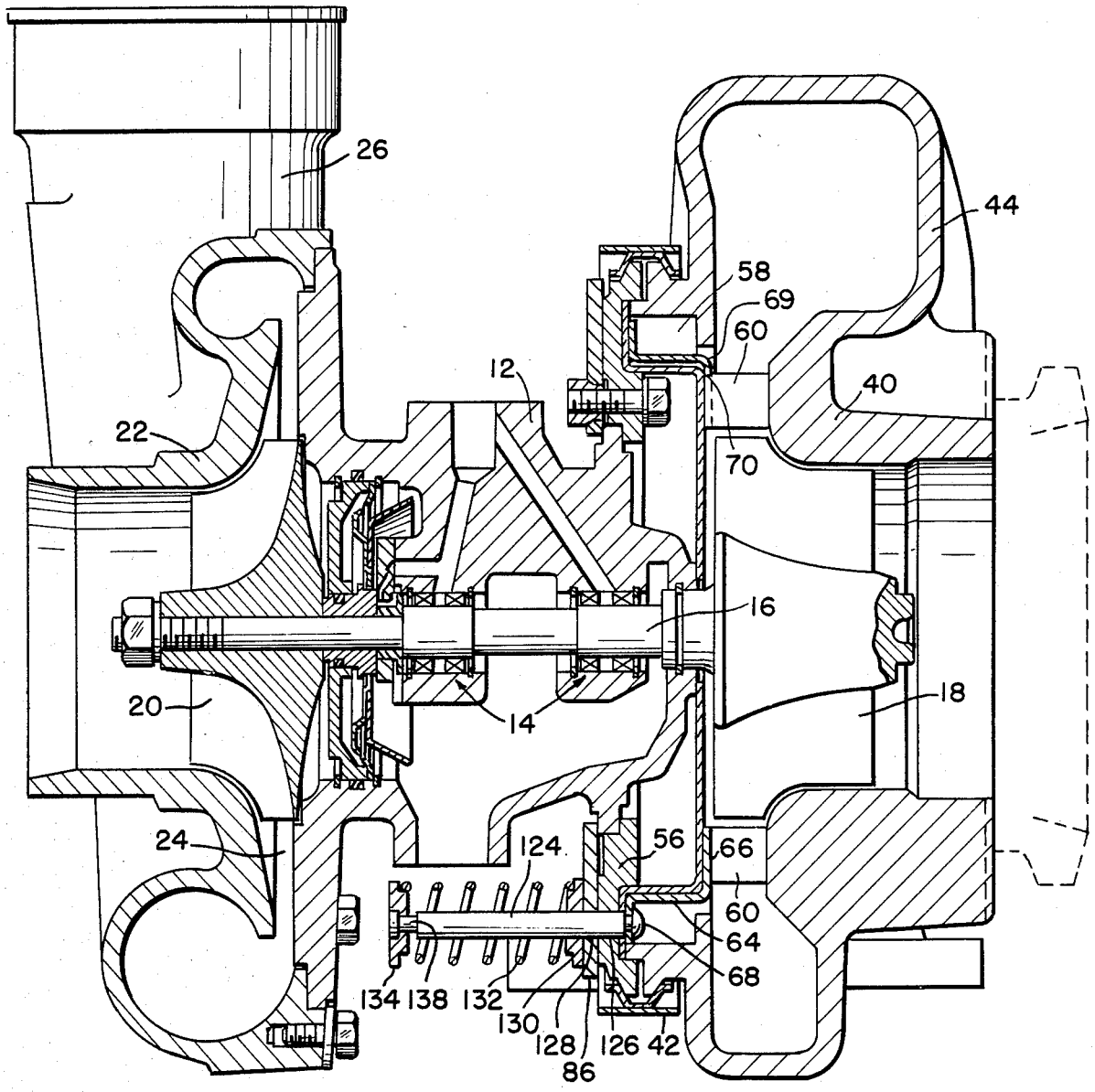

As shown in FIGS. 5 and 6, a plurality of shafts 124 connect to the flange 68 through a slotted connection. Shafts 124 extend through openings 126 in the back plate 56, openings 128 in actuator mounting plate 86, and bushings 130. On each shaft, a spring 132 acts against bushing 130 and against a keeper bushing 134, which is slotted at 136 (see FIG. 6) to enable the keeper bushing 134 to be slipped over the groove 138 in shaft 124.

Figure 4:
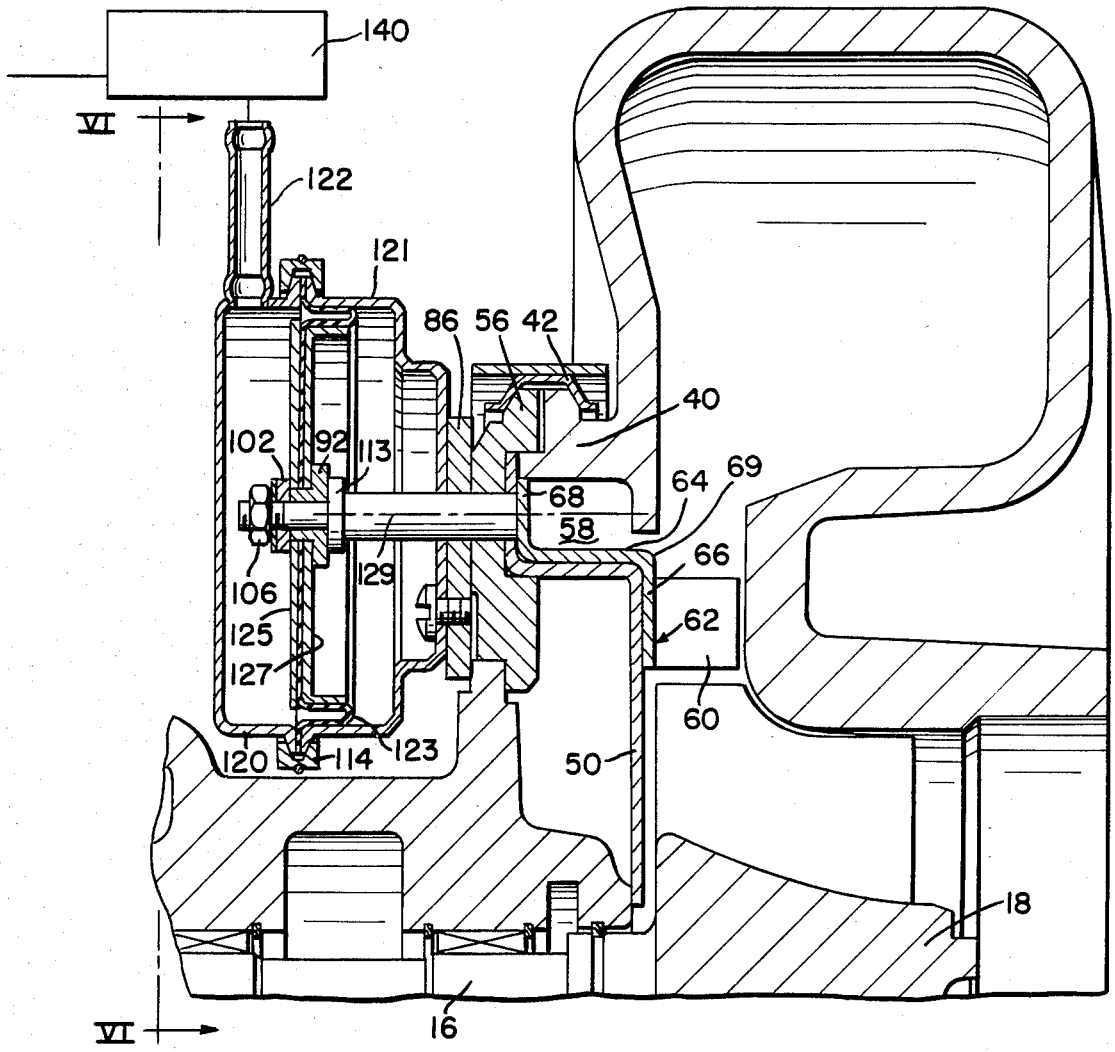
FIGS. 4 and 5 are fragmentary, longitudinal section views of a invention.

In operation, the variable turbine area assembly of FIGS. 4 to 6 is biased to the open position illustrated in FIG. 3 by the springs 132. The pressure in housing 120 can be provided by a suitable means, such as a hydraulic, electronic or pneumatic control system 140, which has a predetermined relationship to the intake manifold pressure and housing speed. For example, the intake manifold pressure may be used to control a pilot valve (not shown) which directs pressurized fluid from a control source to the chamber 120.

The stroke of actuating shaft 129 is sufficient to displace the area control element 62 against turbine housing wall 46 and block flow into the turbine wheel 18. If desired, the pressure in chamber 120 may be elevated to a high level, in co-operation with termination of fuel to engine 34 so that the area control element 62 blocks flow and acts as a compression brake for engine 34.

The means for controlling the pressure in chambers 82 or 120 may be direct when intake manifold pressure is used as the pressure control signal or indirect when the control system 140 is used. It should also be apparent that an operating parameter other than intake manifold pressure can be used for the control signal.

While specific embodiments of the present invention have been disclosed it should be apparent that it may be practiced in other forms without departing from its spirit and scope.

Having thus described the invention, what is claimed as novel and desired to be secured by letters patent in the U.S. Patent Office is:

1. A turbocharger for use with an internal combustion engine and comprising a compressor having a rotatable air pressurizing impeller and a turbine comprising a turbine housing, a radial inward flow turbine wheel mounted for rotation about a central axis within the housing and connected to the compressor impeller, said housing having an annular inlet passage defined by two generally radially extending opposed side walls adjacent the periphery of the turbine wheel through which passage heated engine exhaust flows for driving the wheel, means for controlling the flow area of said passage, said control means comprising an axially displaceable ring element including a thin sheet metal stamping comprising an axially extending sleeve portion, an integral radially extending flange portion at one end of said sleeve portion extending radially inward between said sleeve portion and the periphery of said turbine wheel and a radially outwardly directed flange portion at the other end of said sleeve portion, and means connected to the radially outwardly directed flange portion for displacing the axially displaceable ring element so as to vary the flow area of the inlet passage.

2. A turbocharger as claimed in claim 1 further comprising fixed vanes generally extending into the flow area of the inlet passage and said radially inwardly directed flange portion being slotted to accept the vanes and permit the flange to move along the longitudinal axis of the vanes.

3. A turbocharger as claimed in claim 1 or claim 2, in which at least one side wall of the inlet passage is formed from a thin material.

4. A turbocharger as claimed in claim 1 or claim 2, in which the junction of the radially inwardly directed flange portion with the sleeve portion forms a rounded contour.

5. A turbocharger as claimed in claim 1 or claim 2, in which the displacing means comprises at least two shafts each having one end attached to the radially outwardly directed flange portion, and each shaft extends through an opening in the turbine housing thereby locating the axially displaceable ring element relative to said turbine housing.

6. A turbocharger as claimed in claim 3, in which one of the passage side walls comprises an integral, thin wall sleeve section, and the sleeve portion of the axially displaceable ring element is loosely piloted over the sleeve section of the passage side wall.

7. A turbocharger as claimed in claim 6 in which one of the passage side walls further comprises an integral radially outwardly directed thin wall flange connected to the sleeve section of said passage side wall, and the radially outwardly directed flange of said passage side wall is supported by the turbine housing.

* * * * *